United States Patent [19]

Duncan

[11] 4,362,264

[45] Dec. 7, 1982

[54] CONTAINER CONSTRUCTION

[75] Inventor: Jack E. Duncan, Vincennes, Ind.

[73] Assignee: Packaging Corporation of America, Evanston, Ill.

[21] Appl. No.: 236,505

[22] Filed: Feb. 20, 1981

[51] Int. Cl.[3] ..... B65D 5/48

[52] U.S. Cl. ..... 229/27; 229/15; 229/28 R

[58] Field of Search ..... 229/27, 28 R, 29 B, 229/15

[56] References Cited

U.S. PATENT DOCUMENTS

| | | | |
|---|---|---|---|
| 1,971,863 | 8/1934 | Lupton | 229/15 |
| 2,474,751 | 6/1949 | Morand | 229/28 R |
| 2,697,544 | 12/1954 | Morand | 229/15 |
| 2,718,997 | 9/1955 | Shuxteau | 229/34 R |
| 3,390,810 | 7/1968 | Schneeweiss | 229/15 |
| 3,403,836 | 10/1968 | Farguhar | 229/15 |

*Primary Examiner*—Herbert F. Ross

*Attorney, Agent, or Firm*—Neuman, Williams, Anderson & Olson

[57] ABSTRACT

A container formed from a blank of foldable sheet material is provided for accommodating a plurality of articles arranged in segregated groups. The container includes a pair of opposed first walls, a pair of opposed sectional second walls, a pair of sectional bottom walls and a sectional partition wall, all of which coact to form a compartmented open top chamber in which the groups of articles are adapted to be disposed. The partition wall is provided with a pair of foldably interconnected panel sections which are disposed in face-to-face relation. The partition wall panel sections are provided with reinforcing flaps which extend angularly therefrom and are arranged in face-to-face relation with corresponding second wall panels. Means are provided for foldably connecting the bottom wall panel sections to the corresponding second wall panels.

22 Claims, 14 Drawing Figures

Fig. 1.
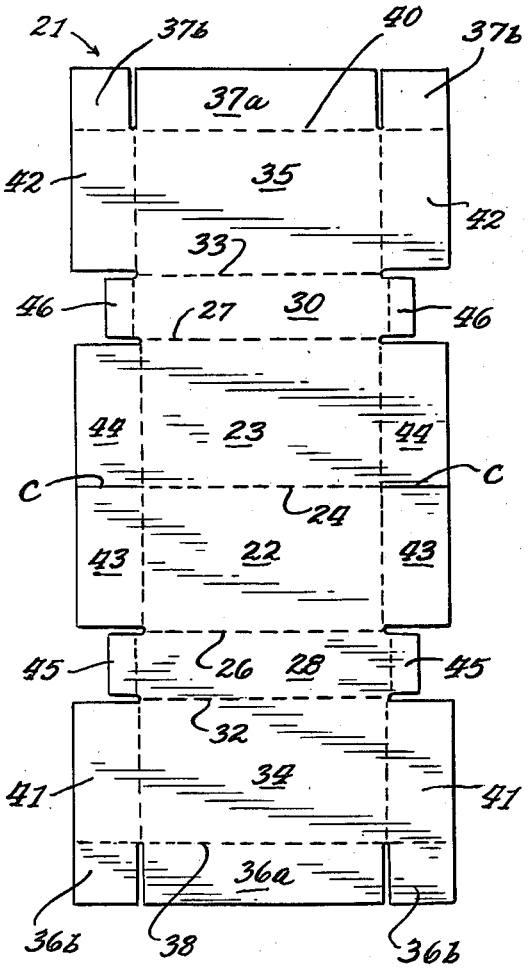
Fig. 2.
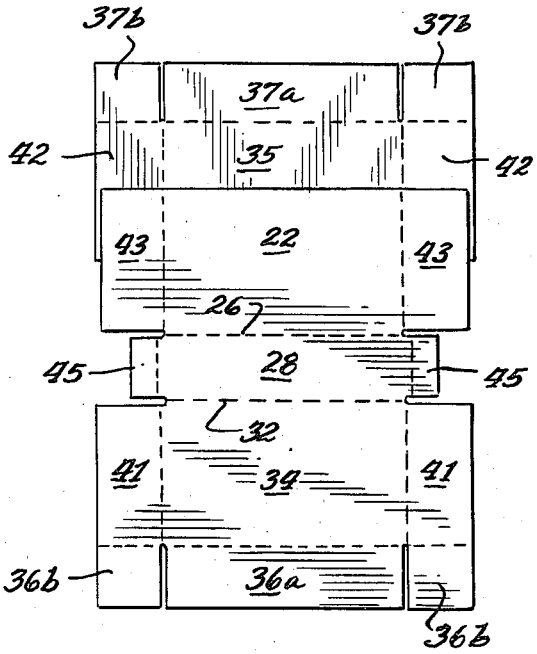
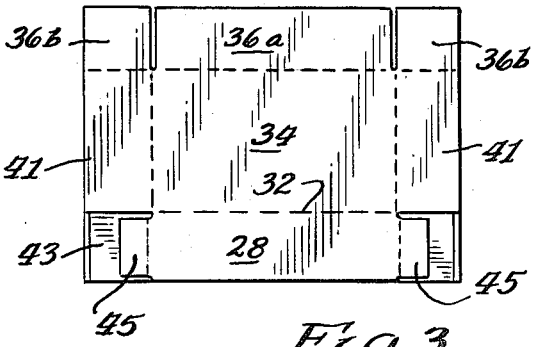
Fig. 3.
Fig. 4
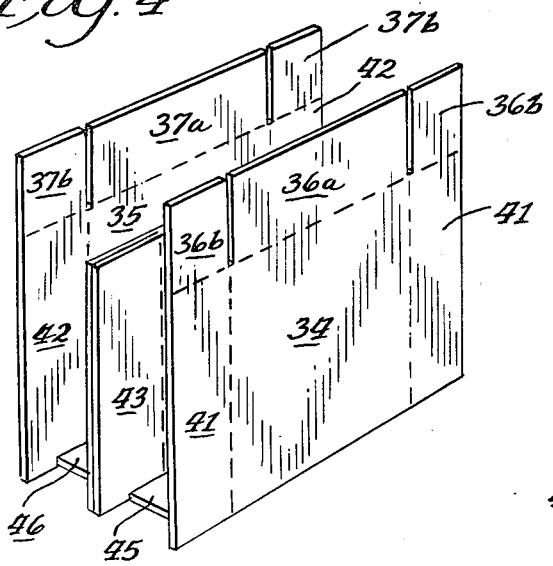
Fig. 5.
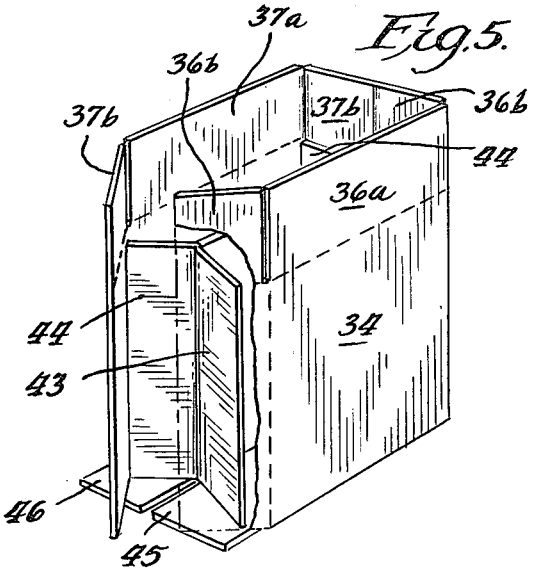

Fig. 10.
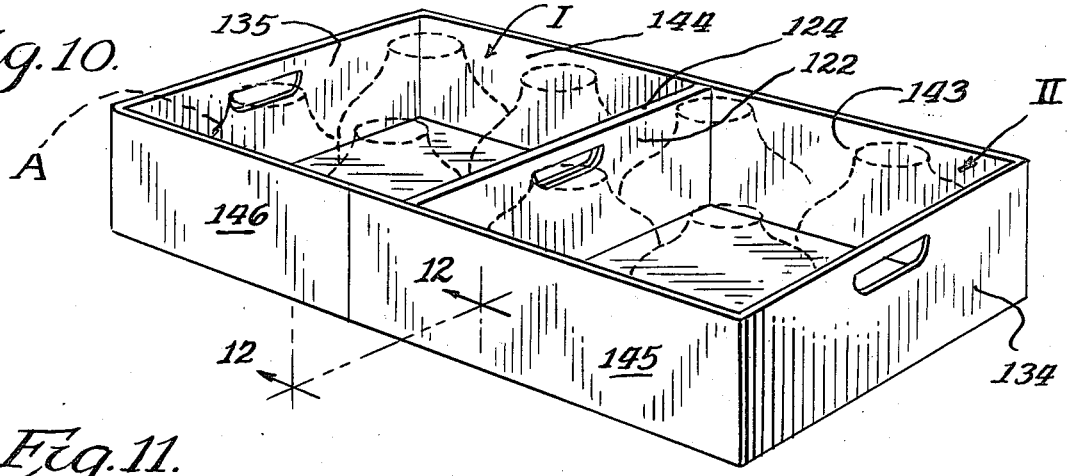
Fig. 11.
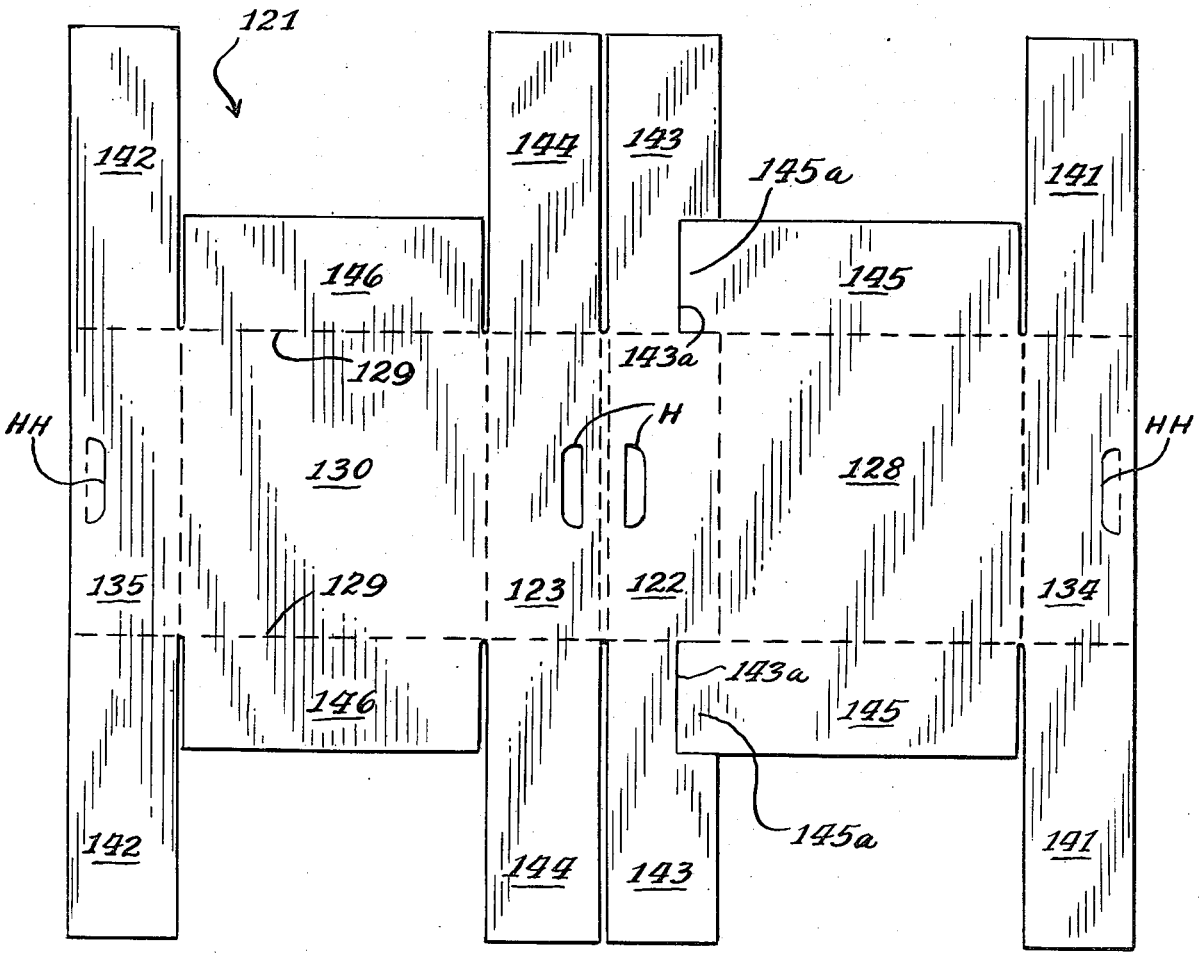
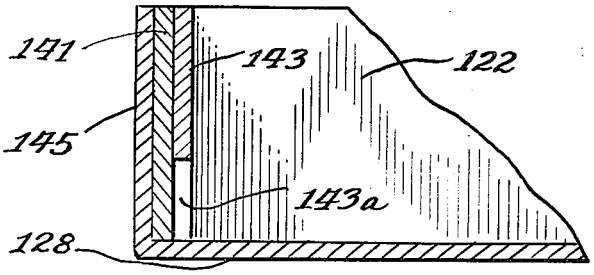
Fig. 12.

CONTAINER CONSTRUCTION

BACKGROUND OF THE INVENTION

At present many liquid products are marketed in large receptacles (e.g. plastic gallon or two liter jugs) which because of their size, shape and material are not suitable for stacking during shipping or for display. Thus, to effectively handle in bulk such receptacles, it is desirable to place same in a suitable container. Various containers for this purpose have heretofore been provided; however, because of certain inherent design characteristics they are beset with one or more of the following shortcomings: (a) they are of costly and complex construction; (b) they are difficult to load and unload manually or with semiautomatic or automatic equipment; (c) they are weak, unstable and incapable of withstanding abusive handling; and (d) they are not readily capable of reuse.

SUMMARY OF THE INVENTION

Thus, it is an object of the invention to provide a container which avoids all of the aforenoted shortcomings.

It is a further object to provide a container which is formed from a single, inexpensive blank that may be readily produced on conventional, high-speed slitting, scoring and slotting equipment.

It is a still further object to provide a container which may be stored in a collapsed or unfolded state until it is ready to be loaded.

Further and additional objects will appear from the description, accompanying drawings and appended claims.

In accordance with one embodiment of the invention, a container is provided for use in accommodating a plurality of articles arranged in segregated groups. The container is formed from a single blank of foldable sheet material and includes a pair of opposed first walls, a pair of opposed sectional second walls, and a sectional bottom wall. The pairs of first and second walls and the bottom wall coact to form an open top chamber. Disposed intermediate and in spaced relation with respect to the first walls and spanning the distance between the second walls is a sectional partition wall which forms the chamber into a plurality of compartments. Each compartment is adapted to accommodate at least one group of articles. Each sectional second wall is provided with a pair of panel sections which are foldably connected to corresponding end edges of the first walls. The corresponding second wall panel sections are folded substantially towards one another and substantially span the distance between the first wall to which it is foldably connected and the partition wall. The sectional partition wall includes a pair of panel sections which are disposed in face-to-face relation. Corresponding first peripheral portions of the partition wall panel sections are connected by an elongated common foldline. To corresponding second peripheral portions of the partition wall panel sections are foldably connected reinforcing flaps which are folded so to engage in face-to-face relation the interior surfaces of the second wall panel sections. The sectional bottom wall includes a pair of panel sections, each of which has one side portion thereof foldably connected to an adjacent first wall and an opposite, or second, side portion thereof foldably connected to a panel section of the partition wall. Means are provided for foldably connecting third peripheral portions of the bottom wall panel sections and the adjacent second wall panel sections.

DESCRIPTION

For a more complete understanding of the invention, reference should be made to the drawings wherein:

FIG. 1 is a top plan view of one form of blank for the improved container.

FIGS. 2 and 3 are top views of the blank of FIG. 1 in successive stages of folding.

FIGS. 4 and 5 are perspective end views of the folded blank of FIG. 3 in successive stages of being squared up.

Figure 7:
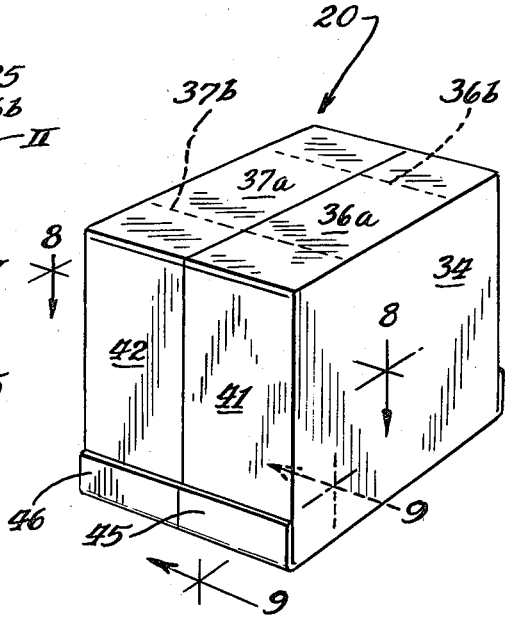
FIG. 7 is like FIG. 6 but showing the loaded container ready for shipment or storage.
Figure 9:
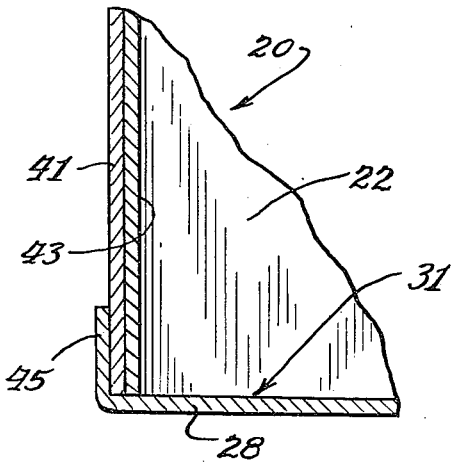
Figure 8:
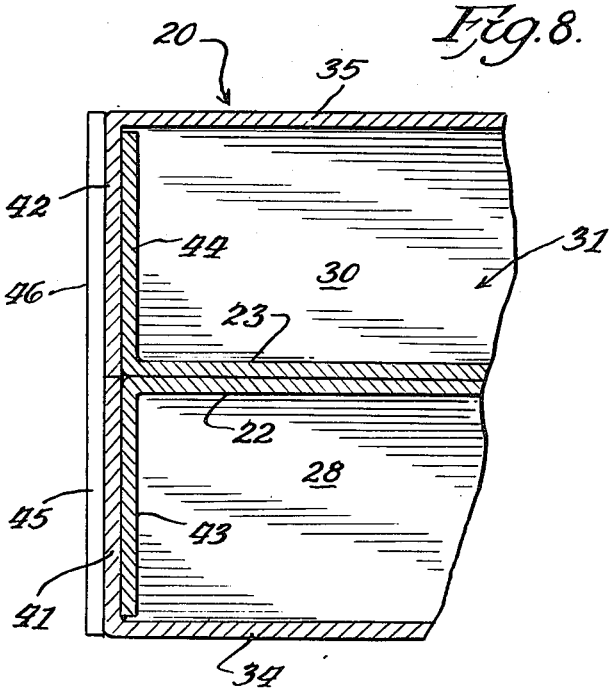

FIGS. 8 and 9 are enlarged fragmentary sectional views taken along section lines 8—8 and 9—9, respectively of FIG. 7.

FIG. 10 is a perspective top view of a second form of the improved container and showing in phantom lines the articles accommodated therein.

FIG. 11 is a top plan view of the blank for the container of FIG. 10.

FIG. 12 is an enlarged fragmentary sectional view taken along line 12—12 of FIG. 10.

Figure 13:
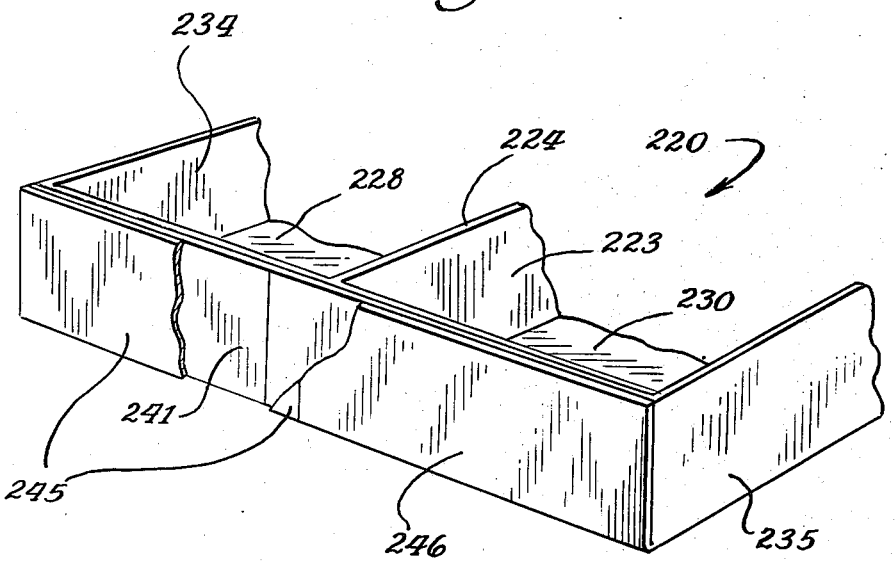

FIG. 13 is similar to FIG. 10, but of a third form of the improved container and showing one of the end flaps with a portion thereof removed so as to show overlapping reinforcing flaps.

Figure 14:
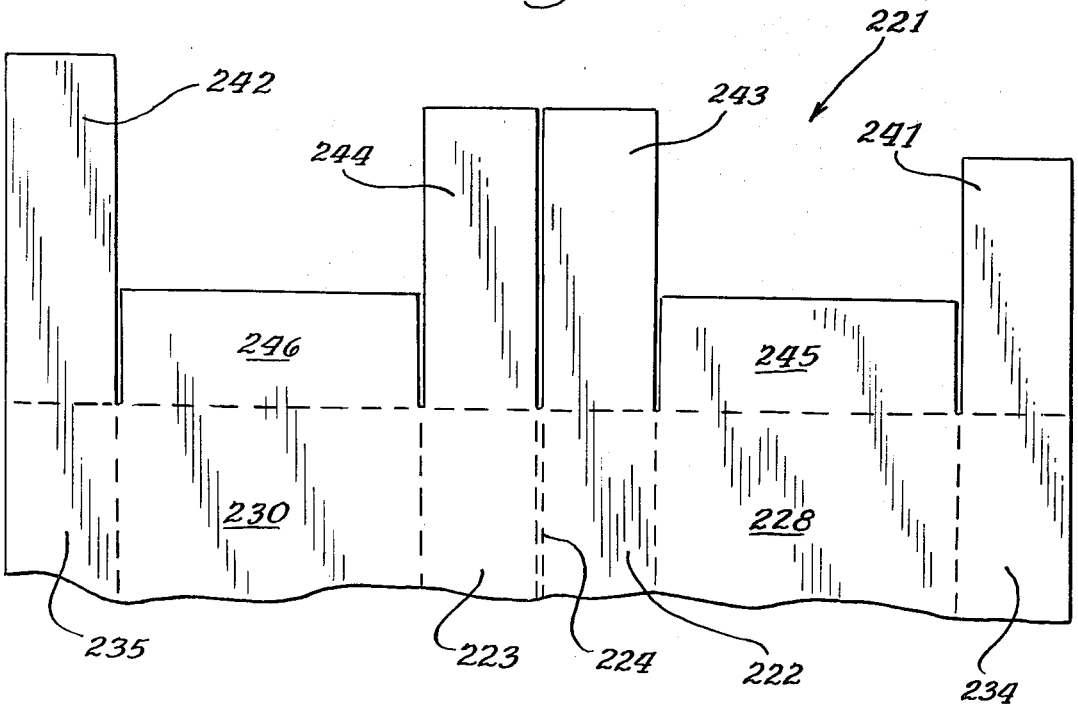

FIG. 14 is a fragmentary top plan view of a blank for the container of FIG. 13.

Figure 6:
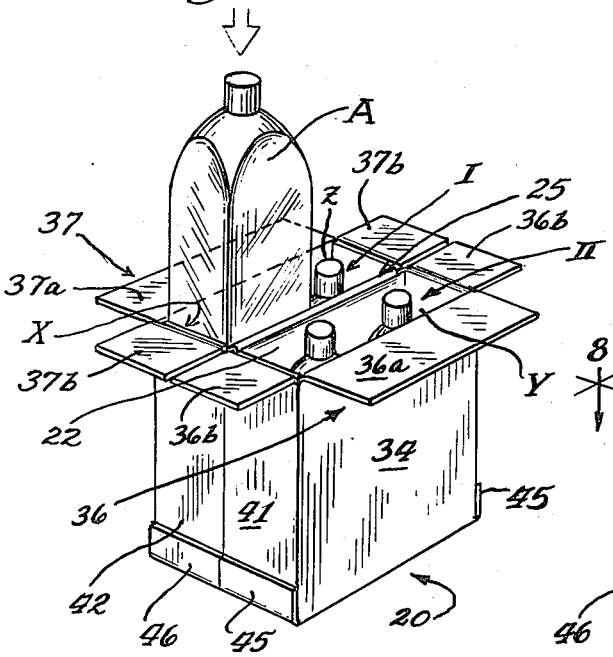
FIG. 6 is a perspective end view of the improved container being top loaded with a plurality of articles.

Referring now to the drawings and more particularly to FIGS. 6 and 7, one form of an improved container 20 is shown which is adapted to accommodate a plurality of articles A arranged in segregated groups I and II. The articles A may be large volume (e.g. one gallon or two liter) receptacles molded of plastic or the like and suitable for receiving a liquid product. In many instances such receptacles are of such construction that they are not suitable for being stacked unassisted one on top of another. Furthermore, the material used in forming such receptacles is highly susceptible to being fractured, scarred and/or pierced when subjected to normal handling while being stored, shipped, or set up for display purposes.

The container 20 is formed from a single blank 21, see FIG. 1, of suitable foldable material such as corrugated double-face fibreboard. The blank is of such shape and size that it may readily be produced by conventional high-speed slotting, scoring and slitting equipment with a minimum amount of material waste.

Blank 21, as seen in FIG. 1, includes at the center a pair of rectangularly shaped panel sections 22, 23 which are interconnected to one another by an elongated foldline 24. When the container 20 is set up, panel sections 22, 23 are folded into face-to-face relation and form an upright partition wall 25, see FIG. 6.

Disposed on opposite sides of panel sections 22, 23 and connected thereto by foldlines 26, 27 are second panel sections 28, 30. Panel sections 28, 30 coact with one another to form a sectional bottom wall 31, see FIGS. 8, 9 when the container is set up for loading. The panel sections 28, 30 are disposed in substantially coplanar relation in the set up container and supportingly engage and subtend the accommodated articles A.

Positioned on opposite sides of the bottom wall panels 28, 30 and connected thereto by foldlines 32, 33, respectively, are side walls 34, 35. In the illustrated embodiment the side walls 34, 35 and the partition wall panel sections 22, 23 are of substantially like configuration. When the container is fully set up, the side walls and the partition wall panel sections are disposed in spaced substantially parallel relation, see FIG. 6.

In the illustrated embodiment of the improved container 20, top closure flaps 36, 37 are provided; however, they are optional and in certain instances may be eliminated. The major top closure flaps 36*a*, 37*a* are connected to corresponding side walls 34, 35 by respective foldlines 38, 40, see FIG. 1.

Foldably connected to opposed sides of each side wall 34, 35 and extending laterally therefrom are end wall panel sections 41, 42, respectively. When the container 20 is fully set up, the corresponding panel sections at each end of the container, are folded towards one another and are in substantially coplanar relation. Each panel section 41, 42 extends the full height of the container and spans the distance between the side wall to which it is connected and the adjacent panel section 22, 23 forming the partition wall 25.

Foldably connected to the opposed sides of each panel section 22, 23 forming the partition wall are reinforcing flaps 43, 44, respectively. The panel sections 41, 42, 43 and 44 are of substantially like configuration and corresponding panel sections 43, 44 are separated from one another by cuts C.

When the container is fully set up, each reinforcing flap 43, 44 is adapted to be disposed in face-to-face relation with the interior surface of the corresponding end wall panel section 41, 42. If desired, the reinforcing flap may be adhesively secured to the corresponding end wall panel section.

As seen in FIG. 1, each end wall panel section 41, 42 has foldably connected thereto minor top closure flaps 36*b*, 37*b* which coact with the adjacent major closure flaps 36*a*, 37*a* to effect closing of the top of the container subsequent to the latter being loaded. It will be noted in FIG. 1 that the folding connections between the minor closure flaps 36*b*, 37*b* and the respective end wall panel sections 41, 42 are axially aligned with the foldlines 38, 40 connecting the respective major closure flaps 36*a*, 37*b* to the side walls 34, 35.

The bottom wall panel sections 28, 30 are secured to adjacent end wall panel sections by end flaps 45, 46, respectively, which extend laterally from opposite ends of panel sections 28, 30. When the container 20 is fully set up, the end flaps 45, 46 will overlie and be adhesively secured to the exterior surface of the adjacent end wall panel sections 41, 42. Thus, a very secure and stable container is formed which is capable of simultaneously accommodating a plurality of articles.

As seen in FIG. 6, when the side walls 34, 35, the end wall panel sections 41, 42, and the reinforcing flaps 43, 44 are squared up, as seen in FIG. 6, they coact with the bottom wall panel sections 28, 30 to form a chamber X. In the illustrated embodiment, the chamber X is formed into contiguous compartments Y, Z by the partition member 25. Each compartment is sized to receive one, or more, segregated groups of articles.

As aforementioned, the side walls 34, 35 and the partition wall panel sections 22, 23 may be of like configuration, in which case, the partition member 25 serves as a vertical reinforcing member when loaded containers are arranged in stacked relation. It is generally preferred that the tops of the accommodated articles be recessed relative to the top edges of the side walls, so that the load of the containers stacked thereabove is borne solely by the side and end walls and the partition member.

In setting up the container 20 from blank 21, panel section 23 is initially folded about foldline 27 so that it will overlie panel section 30 and a part of side wall 35. Simultaneous with this manipulation, partition member panel section 22, bottom wall panel section 28, side wall 34 and the associated top closure flaps 36*a*, 36*b*, end wall panel section 41, end flaps 45 and reinforcing flaps 43 are all folded as a unit about foldline 24 so that the blank assumes the partially folded condition seen in FIG. 2.

Once the blank has assumed the condition shown in FIG. 2, bottom wall panel section 28, side wall 34, closure flaps 36*a*, 36*b* and associated end wall panel section 41 and end flaps 45 are folded as a unit about foldline 26, so as to overlie the remainder of the blank, as seen more clearly in FIG. 3. While the blank is in the folded state as seen in either FIGS. 2 or 3, it may be readily stored until such time it is to be squared up for loading.

When squaring up the partially folded blank of FIG. 3, the two side walls 34, 35 and the two bottom wall panel sections 28, 30 and associated closure flaps and end wall panel sections are simultaneously urged downwardly against a stationary support, not shown, and about foldlines 26, 27 as the fulcrums. When the downwardly directed force is applied, the bottom wall panel sections 28, 30 and associated end flaps 45, 46 will assume coplanar horizontal positions, as seen in FIG. 4, while the side walls 34, 35, associated end wall panel sections 41, 42, and top closure flaps 36, 37 will assume upright positions. The partition member panel sections 22, 23 and associated reinforcing flaps 43, 44 also assume upright positions, as seen in FIG. 4.

Once the partially squared up blank assumes the state shown in FIG. 4, the reinforcing flaps 43, 44 are folded outwardly at substantially right angles from the respective partition member panel sections 22, 23 and span the distances between the partition member 25 and the side walls 34, 35. The corresponding end wall panel sections 41, 42 are then folded towards one another so as to completely overlie the previously folded reinforcing flaps. The overlying end wall panel sections may be adhesively secured to the corresponding reinforcing flaps if desired. Once the end wall panel sections have been folded as indicated, the end flaps 45, 46 are then folded upwardly so as to overlie and be adhesively secured to the exterior surfaces of the respective end wall panel sections. Upon the side walls and end walls having been squared up, the articles A are loaded into the container through the open top, as seen in FIG. 6.

As aforementioned, the inclusion of top closure flaps in the blank is optional. In many situations, it is not necessary for the top of the container to be closed. If, however, top closure flaps 36, 37 are provided, as in the case of the illustrated blank 21, then they are folded relative to one another in a conventional manner subsequent to the loading of the container.

If desired, the top closure flaps may include a single major flap which is foldably connected to the top edge of only one of the side walls 34, 35. In such a case, the major flap, when folded, would overlie both compartments Y, Z and would be adhesively secured to the previously folded minor flaps 36*b* and 37*b*.

Because of the configuration of the reinforcing flaps 43, 44, they present no obstruction, when the articles are being loaded into the compartments Y, Z, and thus, the articles will readily reach the bottom wall panel sections 28, 30 and be effectively supported thereby.

A second form of improved container 120 is shown in FIG. 10. The portions of container 120 which correspond to portions of container 20 will be identified by the same number, but in a 100 series. The principal distinctions between the two containers are that in container 120 the dimensions of the contiguous compartments I and II are substantially greater, thereby enabling two or more rows of articles to be accommodated in each compartment. Furthermore, each partition wall-forming panel sections 122, 123 may be provided with one or more finger holes H. The holes H in the panel sections 122, 123 are aligned with one another when the sections 122, 123 are in face-to-face relation. In lieu of or in addition to the holes H, additional finger holes HH may be provided in walls 134, 135.

In order to prevent folding of the container 120 about foldline 124 when the container is manually carried by utilizing finger holes HH, it is necessary that either the partition wall-forming sections 122, 123 be adhesively secured to one another in face-to-face relation, or that one of the end flaps 145 overlaps an exterior portion of the other end flap 146, see FIG. 10.

In order to attain this desired overlapping, each flap 145 has an end portion 145*a* thereof cut out from the adjoining reinforcing flaps 143, 144, as seen in FIG. 11. Each end portion 145*a* projects endwise beyond the foldline 129 connecting bottom panel 128 to the flaps 145. The cutout 143*a* formed in each reinforcing flap 143 does not seriously weaken the container 120.

In container 120, as illustrated, the end flaps 145, 146 extend the full height of the container wall panels and thus provide added stacking strength to the container.

A third form of improved container 220 is shown in FIG. 13 which is similar in construction to that of container 120, except that in container 220, reinforcing flap 242 has a greater length than that of the flaps 243, 244 and a length that is greater than the widths of the end flaps 245, 246. On the other hand, flap 241 has a length which is shorter than flaps 243, 244 and is shorter than the width of end flaps 245, 246. Thus, when blank 221 is set up to form container 220, the free edges of flaps 241 or 242 will abut one another and be offset from the center partition. Flaps 241, 242 are disposed on the outside of flaps 243, 244 and may be adhesively secured thereto or to the outwardly disposed end flaps 245, 246, see FIG. 13. By reason of the adhesive securement of the flaps, accidental unfolding of container 220 about foldline 224 is avoided, when container 220 is manually carried.

The size and shape of containers 20, 120, and 220 and blanks 21, 121, and 221 therefor may be varied still further from that shown and will depend to a large extent on the type, size and number of articles to be accommodated.

Thus, it will be noted that a simple, inexpensive, yet sturdy container has been provided which is capable of readily accommodating a variety of articles. The container blank may be partially folded for compact storage, and subsequently set up, either manually or by automatic or semiautomatic equipment, just prior to loading. The improved container facilitates the simultaneous handling of a plurality of articles during shipment, storage and for display.

I claim:

1. A container formed from a blank of foldable sheet material for accommodating a plurality of articles arranged in segregated groups, said container comprising a pair of upright non-sectional first walls disposed in opposed space relation; a pair of upright sectional second walls disposed in opposed spaced relation, each second wall including a pair of first panel sections each having a peripheral portion foldably connected to an adjacent first wall; a sectional article-supporting bottom wall coacting with said first and second walls to form an open top chamber for accommodating the groups of articles, said bottom wall including a pair of second panel sections arranged in side-by-side relation with said first panel sections and being angularly disposed relative to said first walls; and a sectional partition wall disposed intermediate and spaced from said first walls and extending between said second walls, said partition wall forming said chamber into contiguous compartments, each compartment accommodating a predetermined number of article groups, said partition wall including a pair of third panel sections disposed in face to face relation and having first peripheral portions thereof foldably interconnected, second peripheral portions being connected to said first panel sections by reinforcing flaps, and third peripheral portions thereof connected to a bottom wall section.

2. The container of claim 1 wherein the contiguous compartments are of substantially like configuration.

3. The container of claim 1 wherein the third panel sections of said partition wall are secured to one another in face to face relation.

4. The container of claim 1 wherein the reinforcing flaps are foldably connected to the second peripheral portions of said third panel sections and are disposed in face-to-face relation with corresponding first panel sections of said second walls.

5. The container of claim 4 wherein the second panel sections of said bottom wall are secured to the exterior of corresponding first panel sections of said second walls.

6. The container of claim 4 wherein the reinforcing flaps are substantially coextensive with the first panel sections of said second walls.

7. The container of claim 4 wherein each reinforcing flap is secured in face-to-face relation to the interior surface of a first panel section; said reinforcing flap and said first panel section secured thereto being of substantially like configuration.

8. The container of claim 1 wherein the first panel sections of said second walls and at least one first wall include foldable, complemental, top closure flaps coacting with one another, when in a predetermined folded relation, to effect closing of the top of said chamber.

9. The container of claim 8 wherein both first walls include foldable top closure flaps, each first wall top closure flap coacting with the top closure flaps of a pair of adjacent first panel sections to effect closing of a compartment of said chamber.

10. A blank of foldable sheet material for forming a container adapted to accommodate a plurality of articles arranged in segregated groups, the container having a pair of opposed non-sectional first walls, a pair of sectional second walls, a sectional bottom wall, and a sectional partition wall, the walls being adapted to coact to form a compartmented open top chamber in which the groups of articles are disposed; said blank comprising a partition wall provided with a pair of panel sections disposed in side-by-side relation and having corresponding peripheral first portions interconnected by a common first foldline; bottom wall panel sections disposed on opposite sides of said partition wall and being foldably connected to corresponding peripheral second portions of said partition wall panel sections; a pair of first walls disposed on opposite sides of said bottom wall panel sections and being foldably connected thereto; pairs of second wall panel sections wherein each pair is foldably connected to opposite sides of one of said first walls, the folding connection between said one of said first walls and a pair of second wall panel sections being angularly disposed relative to the folding connection between the said first wall and a bottom wall panel section; and pairs of reinforcing flaps wherein each pair is foldably connected to opposite sides of a partition wall panel section, the reinforcing flaps disposed on corresponding sides of said partition wall panel sections being separated from one another by a cut, the latter being substantially aligned with the common foldline interconnecting the partition wall panel sections.

11. The blank of claim 10 wherein the folding connections between the partition wall panel sections, and between the bottom wall panel sections and first walls are disposed in spaced substantially parallel relation.

12. The blank of claim 11 wherein the folding axes of the second wall panel sections and the reinforcing flaps are substantially transversely disposed relative to the folding axes of the partition wall panel sections, the bottom wall panel sections and the first walls.

13. The blank of claim 10 wherein the partition wall panel sections and the first walls are of substantially like configuration.

14. The blank of claim 10 wherein at least one first wall is provided with a first top closure flap and the second wall panel sections are provided with complemental second top closure flaps.

15. The blank of claim 14 wherein both of said first walls are provided with first top closure flaps.

16. The blank of claim 10 wherein the second wall panel sections and the reinforcing flaps are of substantially like configuration.

17. The blank of claim 10 wherein the partition wall panel sections are provided with finger holes, the latter being in registered relation when said blank is set up to form the container.

18. The blank of claim 10 wherein the first walls are provided with finger holes.

19. The blank of claim 10 wherein the length of at least one of the second wall panel sections forming a part of one compartment of the compartmented chamber is greater than the spacing between a partition wall panel section and a corresponding first wall forming the one compartment, whereby a portion of the said one second wall panel section is secured to another flap forming a part of the other compartment of the compartmented chamber.

20. The blank of claim 10 wherein a pair of end flaps are foldably connected to opposed peripheral segments of each bottom wall panel section; said pair of end flaps being adapted to coact with corresponding second wall panel sections and reinforcing flaps to form opposing second walls of the chamber compartments.

21. The blank of claim 20 wherein an end portion of at least one end flap is struck out from an adjacent reinforcing flap whereby said end portion is adapted to overlap and be secured to a corresponding end flap when said blank is set up to form the container.

22. The blank of claim 19 wherein the other of the second wall panel sections has a length less than the spacing between a partition wall panel section and a corresponding first wall forming the one compartment; the free end portions of said second wall panel sections being in substantially abutting relation and forming a joint therebetween, said joint being offset relative to the partition wall separating the compartments.

* * * * *